US005115279A

United States Patent [19]

Nishikawa et al.

[11] Patent Number: 5,115,279

[45] Date of Patent: May 19, 1992

[54] FIXING DEVICE

[75] Inventors: Hisashi Nishikawa; Ikuo Fujisawa; Yukihiro Ohsugi, all of Shizuoka, Japan

[73] Assignee: Tokyo Electric Co., Ltd., Tokyo, Japan

[21] Appl. No.: 560,828

[22] Filed: Jul. 31, 1990

[30] Foreign Application Priority Data

Jul. 31, 1989 [JP] Japan ..... 1-199071
Apr. 26, 1990 [JP] Japan ..... 2-110770

[51] Int. Cl.[5] ..... G03G 15/20

[52] U.S. Cl. ..... 355/290; 219/216; 355/285; 355/295

[58] Field of Search ..... 355/282, 285, 289, 290, 355/295; 219/216, 469, 471, 219

[56] References Cited

U.S. PATENT DOCUMENTS 4,941,021 7/1990 Uchida et al. ..... 355/285

FOREIGN PATENT DOCUMENTS 029590 12/1988 European Pat. Off. ..... 355/285
0046370 3/1983 Japan ..... 355/290
0198071 11/1983 Japan ..... 355/290
2027640 2/1980 United Kingdom ..... 355/295

*Primary Examiner*—A. T. Grimley
*Assistant Examiner*—Thu Dang
*Attorney, Agent, or Firm*—Oblon, Spivak, McClelland, Maier & Neustadt

[57] ABSTRACT

According to the present invention an exothermic member is provided freely rotatably and formed in a ring form composed of an exothermic resistor layer of high resistivity formed on an inner peripheral surface and a conductor layer of low resistivity formed on the outer peripheral surface of the exothermic resistor layer. A medium-leading member is provided for forming a conveyance path for media with the outer peripheral surface of the exothermic member in between and a pressing electrode member is provided for supporting the exothermic member in abutting against the exothermic resistor layer in a conductive state in a position opposing to the medium-leading member. A power supplying electrode is also provided being connected to the conductor layer making contact at least with a brim part on one side of the exothermic member and voltage is applied between the exothermic member and the pressing electrode member by a power supply and only a part of the exothermic member against which the pressing electrode member is abutting generates heat. Such a structure allows for fixing an image to be transcribed consisting essentially of toner formed on a recording medium when it passes through this part of the conveyance path.

18 Claims, 16 Drawing Sheets

FIXING DEVICE

FIELD OF THE INVENTION AND RELATED ART STATEMENT

The present invention relates to a fixing device for fixing developing agent on a recording medium by pressing and heating.

At present, printers of various kinds of systems are actually in use, for example, in the case of a laser printer utilizing electrophotographic technology, toner, a kind of developing agent, is electrostatically formed into an image and the image is transcribed onto a printing paper, a kind of recording media, and the printing paper is pressed and heated in a fixing device for fixing the toner image stuck on the printing paper; thus printing is performed.

An example of conventional fixing devices used in a printer as mentioned in the above will be explained in the following referring to FIG. 24 to FIG. 26. At first, the whole constitution of a laser printer 2 having a built-in fixing device 1 is shown in FIG. 26. In the laser printer 2, a printing paper conveyance path 7 is formed from a paper supply box 3 to a paper discharge portion 6 installed in the upper part of the device through a transcription portion 4 and a fixing portion 5. In the transcription portion 4, a transcripter 8 and a photoreceptor drum 9 are opposingly disposed; a toner cleaner 10, an electric charge removing lamp 11, an electrificating device 12, an exposing device 13 and a developing device 14 are successively disposed on the peripheral surface of the photoreceptor drum 9.

In the fixing device 1 disposed in the fixing portion 5, a fixing roller 16 and an opposing roller 17 are connected by each other with a gear mechanism 15 and are opposingly disposed by the printing paper conveyance path 7 between as shown in FIG. 24 and FIG. 25. The fixing roller 16 comprises a metallic cylindrical member 19 of aluminum etc., having a pipe-shaped halogen lamp 18 in its center, and on the outer peripheral surface a cleaning pad 20, a cleaning means, infiltrated with silicon oil (not shown in the drawing), a parting agent, and a temperature sensor 21 are abutted against each other being pressed. The opposing roller 17 is sheathed with heat resistant rubber 22.

In a device having such a constitution, a printing paper 23, a recording medium, is supplied from the paper supply box 3 and is conveyed toward the transcription portion 4 through the printing paper conveyance path 7. The outer peripheral surface of the photoreceptor drum 9 which rotates in synchronization with the movement of the printing paper 23, from which residual toner is removed by the toner cleaner 10 and which is uniformly electrified by the charge removing lamp 11 and the electrifying device 12; an electrostatic latent image formed on the outer peripheral surface of the drum 9 with the exposing device 13 is developed with the developing device 14 and the image to be transcribed (not shown in the drawing) consisting essentially of toner, a developer, is formed. The image to be transcribed on the outer peripheral surface of the photoreceptor drum 9 is successively transcribed by the transcription voltage of the transcribing device 8 onto the surface of the printing paper 23 led to the transcription portion 4; thus a transcription image is completed.

Next, the printing paper 23 is conveyed from the transcription portion 4 toward the fixing portion 5 through the printing paper conveyance path 7, and it is led into the gap between the fixing roller 16 and the opposing roller 17 which are rotating in synchronization with the movement of the printing paper. In this time, residual toner on the outer peripheral surface of the rotating fixing roller 16 is removed with the cleaning pad 20, and the outer peripheral surface is heated with the light-output of the halogen lamp 18. When the printing paper 23, on which a transcription image composed of toner is stuck, passes through the gap between the heated fixing roller 16 and the opposing roller 17 composed of heat resistant rubber 22, the resin component of the toner is melted and the transcription image is fixed on the printing paper 23.

The printing paper on which an image is formed as mentioned in the above is discharged from the paper discharge portion 6; thus the printing operation of the laser printer 2 is completed.

The temperature sensor 21 of the fixing device 1 constantly detects the temperature on the outer peripheral surface of the metallic cylindrical member 19, and controls the light-output of the halogen lamp 18 through a control circuit etc. In other words, the fluctuation of the light-output of the halogen lamp 18 caused by the change of environmental temperature or voltage fluctuation, or temperature drop of the metallic cylindrical member 19 caused by continuous printing, can be corrected by constant control of the output of the halogen lamp 18; thereby the temperature of the fixing roller 16 can be kept constant. In the case of warming up of a device the temperature of the fixing roller 16 is arranged to make a sharp rise by raising the output of the halogen lamp 18.

The problem in the prior art is described in the following. In a fixing device 1 of this type, the metallic cylindrical member 19 is heated with the light-output of the halogen lamp 18, so that a temperature sensor and a control circuit are needed for keeping the temperature of the fixing roller 16 constant or for shortening the warming up time. Therefore, the number of parts is increased and the cost for parts is made high, moreover there is a demerit of making every process from design to manufacture complicated.

There is a probability that the output light of the halogen lamp 18 for heating the fixing roller 16 leaks out to the exterior of the device; therefore, in the case of a laser printer 2 or the like in which image forming is done by the scanning of light, it is necessary to strictly shield the light from the fixing device 1. Because of this, the structure of the laser printer 2 becomes complicated and the productivity of the device is degraded, moreover there is a demerit of limiting the degree of freedom of designing the layout of each portion.

To solve such problems, a fixing roller has been developed in which an exothermic function of ceramics is utilized. In such a case, an insulation layer and an exothermic resistor layer composed of ceramics etc. are provided in order on the surface of a cylindrical basic material and the layers are coated with a parting material composed of fluororesin etc., and electrode rings connected to the exothermic resistor layer are provided on both end parts of the cylinder. Electricity is supplied to these electrode rings through brushes etc. for making the exothermic resistor layer generate heat. When a fixing device is formed utilizing the above-mentioned fixing roller, the surface temperature of the fixing roller is raised by the exothermic function of the ceramics and not raised by the light-output of a halogen lamp. Therefore, it is made easy to speed up a warming up time or to uniformalize the temperature of generated heat; thereby a special control circuit for uniformalizing the temperature of the fixing roller 16 becomes unnecessary. Moreover the shielding of the device for the light-leak is not necessary.

In the case of a fixing device of this kind, however, there is a demerit that the whole outer peripheral surface is made to generate heat and so the power consumption becomes large and naturally the temperature rise of environmental atmosphere becomes high.

OBJECT AND SUMMARY OF THE INVENTION

A first object of the present invention is to obtain a fixing device of a simple structure in which a control circuit for controlling the temperature of a fixing roller is not needed.

A second object of the present invention is to obtain a fixing device which does not need light-shielding.

A third object of the present invention is to obtain a fixing device of small power consumption.

A fourth object of the present invention is to obtain a fixing device which does not raise the environmental temperature much.

To achieve the above-mentioned objects, the following are provided in a device according to the present invention: an exothermic member is freely rotatably provided being formed in a ring shape composed of a exothermic resistor layer of high resistivity formed on the inner peripheral surface and a conductive layer of low resistivity formed on the outer peripheral surface of the exothermic resistor layer; a medium-leading member is provided making contact with the outer peripheral surface of the exothermic member and forming a recording medium conveyance path between the outer peripheral surface of the exothermic member; a pressing electrode member is provided being connected to the exothermic resistor layer by supporting it with the medium-leading member in between being abutted to the exothermic member in the opposing position to the medium-leading member; a power supplying electrode is provided being connected to the conductor layer making contact with at least a brim part on one side of the exothermic member; and a power supply is provided for applying a voltage between the power supplying electrode and the pressing electrode member. Thereby, when a voltage is applied by the power supply between the power supplying electrode and the pressing electrode member, the exothermic resistor layer of the exothermic member generates heat. Because of this, when a recording medium passes through the path between the exothermic member and the medium-leading member, an image to be transcribed in an unfixed state is fixed. In this case, the heat generation of the exothermic member is performed by exothermic behavior of an exothermic body energized with electricity, so that it is easy to shorten a warming up time or to uniformalize the exothermic temperature, and a special control circuit is not needed, and further the light-shielding of a device using a fixing device is neither needed. In the exothermic resistor layer of the exothermic member, heat is generated only in the opposing part to the medium-leading member which forms the conveyance path for the recording media; therefore the power consumption is small and the environmental temperature is not raised much.

When a detection sensor for detecting a recording medium which is moved to the fixing portion through the conveyance path and a timer circuit for controlling the power supplying period to the exothermic member corresponding to detection of a medium by the detection sensor are additionally provided, the exothermic drive for the exothermic member can be synchronized with the existence of a recording medium. Owing to this, the power consumption and the temperature rise in the environment can be further decreased.

Furthermore, when a parting material layer which is repellent to developing agent is formed on the outer peripheral surface of the exothermic member and a cleaning means for wiping off residual developing agent is provided, developing agent is wiped off from the exothermic member, so that the recording media which pass through the conveyance path can be prevented from adhesion of dirt. In the case of a cleaning means, it is preferable to dispose a cleaning means which has the structure to apply a parting agent to the parting agent layer in a position where the temperature is higher than that of the melting point of residual developing agent, or to dispose one which has the structure to scrape off a parting agent in a position where the temperature is lower than that of the melting point of residual developing agent.

BRIEF DESCRIPTION OF THE DRAWINGS

FIG. 5(*b*) is a vertical sectional side view of a principal part.

FIG. 6(*b*) is a vertical sectional side view of the device shown in FIG. 6(*a*).

FIG. 7(*b*) is a vertical sectional side view of the device shown in FIG. 7(*a*).

FIG. 9(*b*) is a vertical sectional side view of a principal part.

FIG. 10(*b*) is a vertical section side view of the device shown in FIG. 10(*a*).

FIG. 11(*b*) is a vertical sectional side view of the device shown in FIG. 11(*a*).

FIG. 13(*b*) is a plan view showing the whole.

FIG. 22(*b*) is a vertical sectional side view of the device shown in FIG. 22(*a*).

FIG. 25(*b*) is a vertical sectional side view of the device shown in FIG. 25(*a*).

DESCRIPTION OF PREFERRED EMBODIMENTS

A first embodiment of the present invention will be explained in the following based on FIG. 1 to FIG. 6. The present embodiment is an embodiment according to the invention described in claims 1, 2, 3, 4, 5, and 9. For the similar parts to those in the fixing device described in the above the similar names and notes will be given and the explanation on them will be omitted.

Figure 1A:
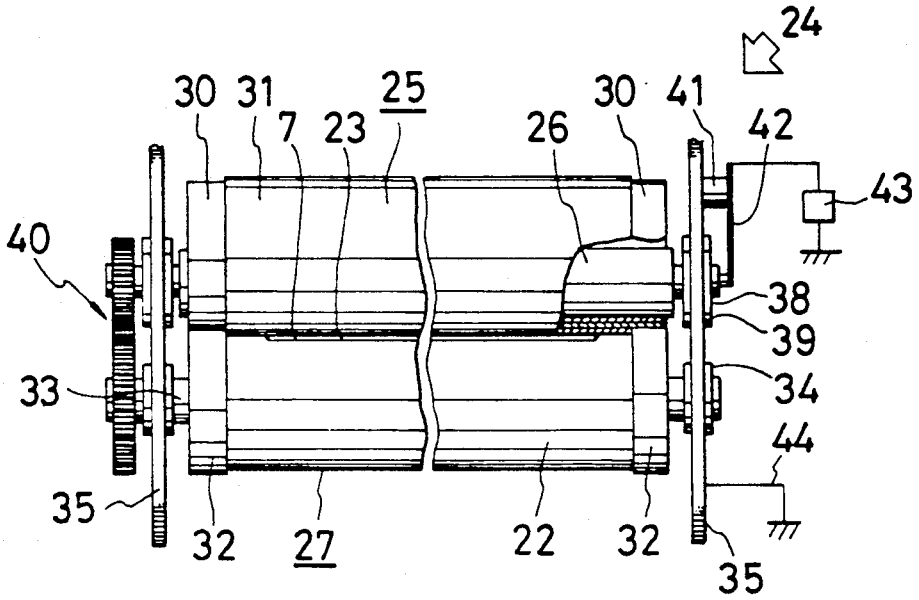
FIG. 1(*a*) is a fragmentary front view showing the whole of a first embodiment of the present invention.
FIG. 1(b) is a vertical sectional side view of the device shown in FIG. 1.
Figure 1B:
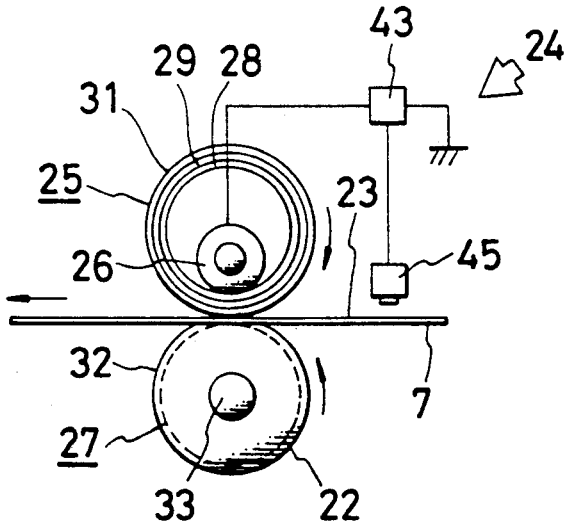
Figure 2:
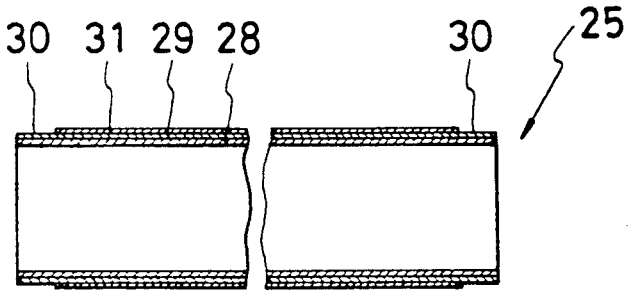
FIG. 2 is a vertical sectional front view of a fixing roller.
Figure 3:
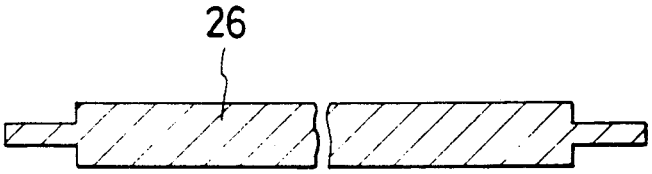
FIG. 3 is a vertical sectional front view of an electrode roller.
Figure 4:
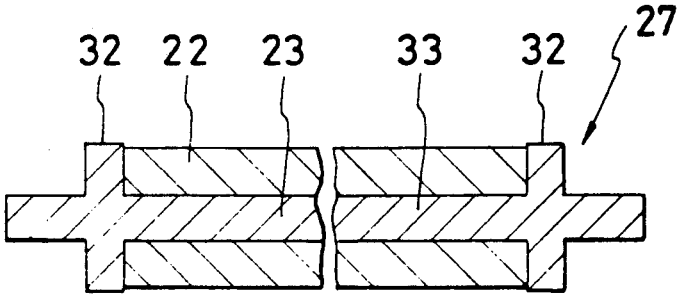
FIG. 4 is a vertical sectional front view of an opposing roller.

In the fixing device 24 as shown in FIG. 1, a fixing roller 25, an exothermic member formed in a cylindrical shape, is pressed against an opposing roller 27, a medium-leading member, by an electrode roller 26, a pressing member for supplying power provided in the inner peripheral part of the fixing roller 25. The fixing roller 25 is, as shown in FIG. 2, constituted with a conductor layer 29 composed of chromium-nickel alloy etc. formed with a sputtering method etc. on the peripheral surface of a cylinder-shaped exothermic resistor layer 28 formed by injection molding or the like of polycarbonate or polyimide resin mixed with carbon, and with a parting agent layer 31 formed with fluororesin coating etc. over the conductor layer 29 except both end parts 30. The electrode roller 26 is formed with a material of high conductivity such as metal or the like, and it is driven to rotate by a connected driving source (not shown in the drawing). The opposing roller 27 is constituted, as shown in FIG. 4, with a core material 33 covered with heat-resisting rubber 22; the core material 33 is composed of metal etc. having flange-shaped power supply electrodes 32 on both end parts, and each of these electrodes constitutes part of the electricity path.

In the fixing device 24, the opposing roller 27 which is fixed to the frame 35 conductively through bearings 34 and the electrode roller 26 which is fixed to the frame 35 in an insulated state through an electrode mounting/dismounting mechanism 110 are connected with a gear mechanism 40 made of an insulating material such as resin etc. The electrode mounting/dismounting mechanism 110 is so constituted that the electrode 26 is fixed to a U-shaped engagement groove formed on the frame 35 with the force of a spring 37 in an insulated state through bearings 38 and an insulating ring 39. Therefore, the fixing roller 25 is held freely rotatably between the rollers 26 and 27 in the state where the exothermic resistor layer 28 is conductively connected to the electrode roller 26 and the end parts 30 of the conductor layer 29 are conductively connected to the power supply electrode 32 of the opposing roller 27.

A power supply portion 43 is connected to a brush 42 being fixed to the frame 35 through an insulating spacer 41 and abutting against an end part of the electrode roller 26; a grounding line 44 is connected to the frame 35 which is conductively connected to the opposing roller 27. Further, in the fixing device 24, a printing paper detection sensor 45, composed of photoelectric conversion elements etc., disposed on the printing conveyance path 7 is connected to the power supply portion 43 through a timer circuit (not shown in the drawing).

Figure 5A:
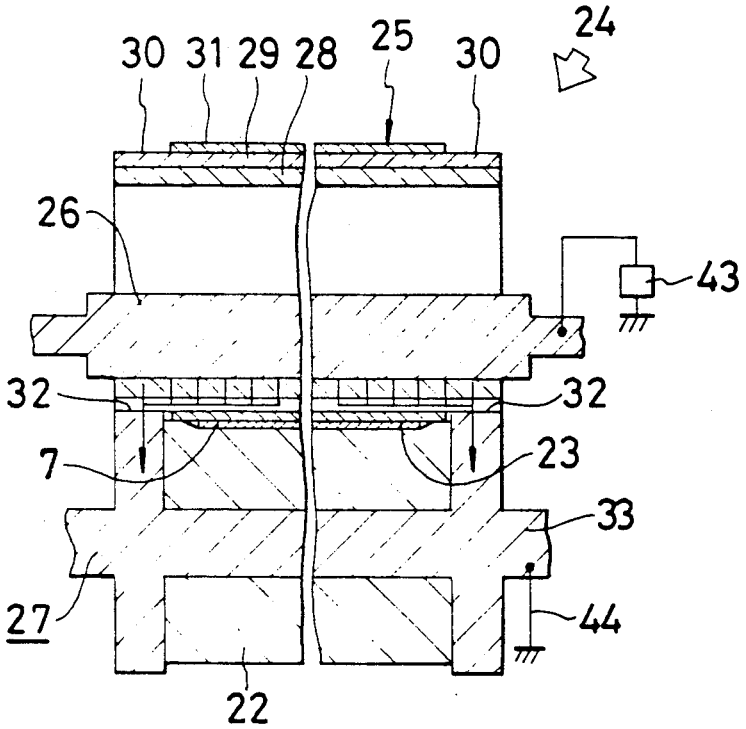
FIG. 5(*a*) is a vertical sectional front view in the state where electricity is being supplied.
Figure 5B:
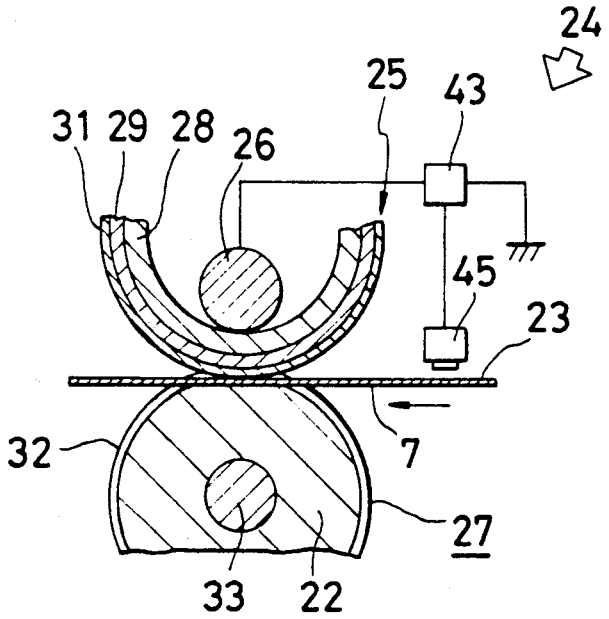
Figure 6A:
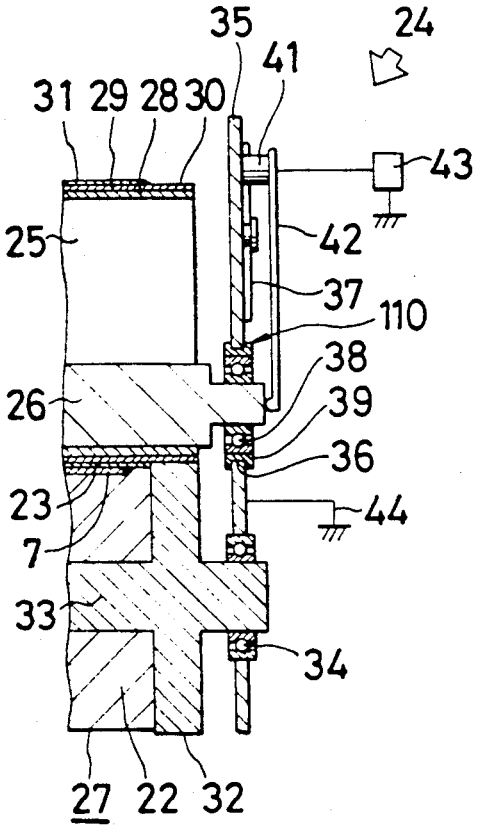
FIG. 6(*a*) is a vertical sectional front view of a principal part.
Figure 6B:
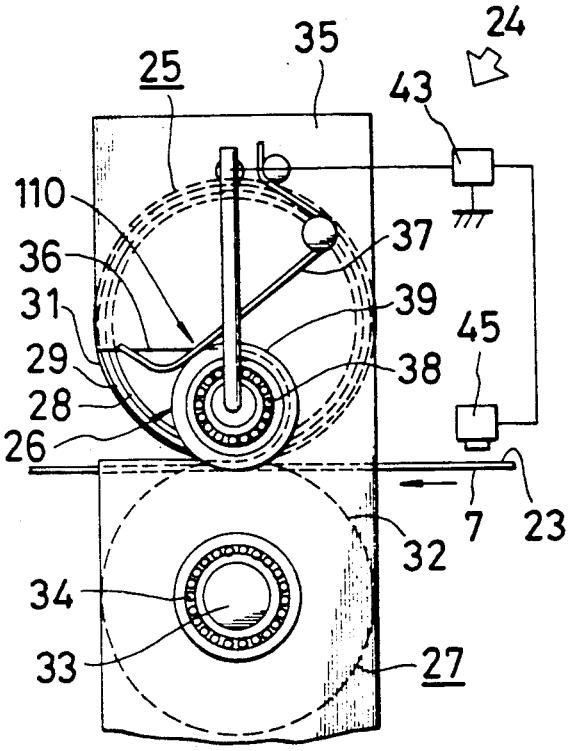

The fixing device 24 with the constitution as mentioned above, similar to the fixing device 1, is used being disposed in the fixing portion 5 of a laser printer 2 and so forth. When a printing paper being conveyed on the printing paper conveyance path 7 is detected by the printing paper detection sensor 45, the fixing device 24 starts operating at a specified timing being controlled by the timer circuit. In other words, when a printing paper 23 stuck with a transcription image composed of toner and a developing agent, reaches the fixing portion 5, each of the rollers 25 to 27 is rotated in a specified direction by the electrode roller 26, to which a driving source is connected, through a gear mechanism 40 etc., and power is supplied to the electrode roller 26 by the power supply 43. As shown in FIG. 5, the current flows from the exothermic resistor layer 28 on the fixing roller 25 to the conductor layer 29 and from its end parts 30 further flows to the grounding line 44 through the core material 33 of the opposing roller 27, the bearings 34 and the frame 35. In the fixing device 24, power is supplied symmetrically about the width direction of the fixing roller 25 by the electrode roller 26 and the core material 33 of the opposing roller 27.

The exothermic resistor layer 28 of the fixing roller 25 is energized only by the part situated between the two rollers 26 and 27, so that only the part facing a printing paper 23 generates heat. In the fixing device 24 a fixing process is performed when a printing paper 23 passes through between the fixing roller 25, in which only the part which presses the surface of the printing paper 23 generates heat, and the opposing roller 27.

The present applicant manufactured a fixing roller comprising laminated layers composed of exothermic resistor layers of resin films, each film having a thickness of 100 μm, and conductor layers composed of metal, each layer having a thickness of 1 μm, and the laminated product being covered with a fluororesin film having a thickness of 20 μm. It was confirmed that the surface temperature of the roller reached a value necessary for fixing with the supply of electricity for a very short time. It shows that a warming time can be very short by forming the fixing roller 25 with the structure as shown in the present embodiment. At the same time, as it becomes easy to maintain the temperature of the exothermic part of the fixing roller 25 at a constant value, any special control circuit for keeping a constant temperature is not needed. Power consumption is also decreased. In addition, the exothermic part does not emit light, so that light-shielding for the fixing device 24 is not needed. The electrode roller in the present embodiment works for both purposes, the driving for the rotation of the fixing roller 25 and the supply of electricity to the exothermic resistor layer 28, so that it is made possible to simplify the structure of the device and to decrease the number of parts for it; this contributes to the miniaturization, the decreasing of weight and the improvement of productivity of the device. The similar things can be said about the opposing roller 27 in the present embodiment. It is because of the reason that an electrode 32 for supplying electricity making conductive contact to the conductor layer 29 is formed on the opposing roller 27, so that the opposing roller 27 works for both purposes, the lead of a recording medium 23 and the supply of electricity to the fixing roller 25.

In the fixing device 24 of the present embodiment, an electrode mounting/dismounting mechanism 110 which holds the electrode roller 26 to be freely mountable/dismountable with the engagement groove 36 formed on the frame 35 and the spring 37 is formed; therefore, for example, even though the fixing roller 25 is worn by the friction with printing papers or by the electric discharge abrasion, the roller can be easily changed.

Electricity flows from the electrode roller 26 to the fixing roller 25 symmetrically about the direction of width; therefore, uniform fixing for a recording medium 23 can be performed.

The supplying time of electricity to the fixing roller 25 is limited to only necessary time for the fixing of a recording medium 23 by the functions of printing paper detection sensor 45 and the timer circuit. Therefore, not only is power consumption decreased but also the temperature rise around the fixing device can be restrained.

In the fixing device of the present embodiment, an example in which the electrode roller 26 and the opposing roller 27 are connected with each other through the gear mechanism 40 is shown, but for example it is possible to freely fix the opposing roller 27 on the frame 35. In the present embodiment, explanation is made assuming that the fixing device 24 is set up in a printer of an electrophotographic system, but this does not limit the present invention; the fixing device 24 can be applied to various kinds of printing machines in which developing agent to be fixed by pressurization and heating is used. In the fixing device 24 in the present embodiment, the explanation on the driving and control is made in such a way that when a printing paper 23 reaches the fixing portion 5, each of the rollers 25 to 27 starts rotating and electricity is supplied to the electrode roller 26, but it is also possible, for example, that each of the rollers 25 to 27 are normally rotating and when a printing paper 23 reaches the fixing portion 5, the electrode roller 26 is energized to make the fixing roller 25 generate heat. In the fixing device 24 in the present embodiment, a fixing roller formed by laminating the exothermic resistor layer 28 made of resin and the conductor layer 29 made of metal is shown, but the present invention is not limited to the above-mentioned constitution; a resin cylinder or a metallic cylinder can also be used in which the resistivity of the inner peripheral part is arranged to be higher than that of the outer peripheral part, for example, being arranged by adjusting mixing materials. It was confirmed in an experiment that if the ratio between the resistivity of inner and outer peripheries was more than 3, the temperature distribution was uniform and a good property was obtained.

Figure 7A:
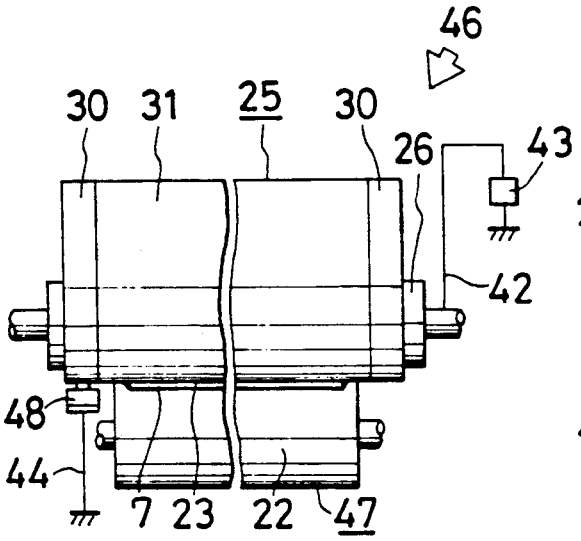
FIG. 7(*a*) is a fragmentary front view showing the whole of a second embodiment of the present invention.
Figure 7B:
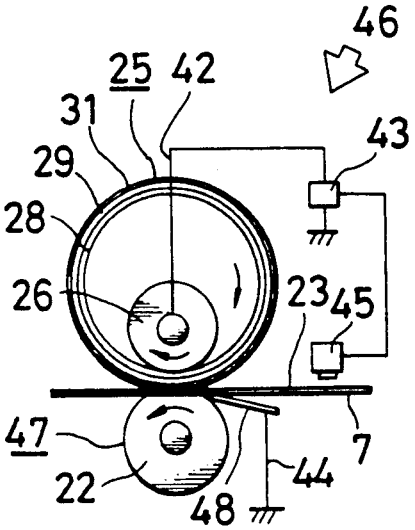

Next, a second embodiment of the present invention will be explained based on FIG. 7. The present embodiment is an embodiment of the invention described in claims 1, 2, and 9. In the fixing device 46, power supply electrode 32 is not provided, and an opposing roller 47, a medium-leading member, is formed to have a similar width to that of the parting material layer 31 of the fixing roller 25, and a grounding line is connected to a brush 48, a power supply electrode, being abutted against the end part 30 of the conductor layer 29 of the fixing roller 25.

In the constitution as mentioned above, the fixing device 46 functions as the fixing device 24 does. In the fixing device 46 in the present embodiment, for the connection between the grounding line 44 and the fixing roller 25, the frame 35 does not lie between them, so that the conductivity between them is good resulting in a stable performance.

Figure 8:
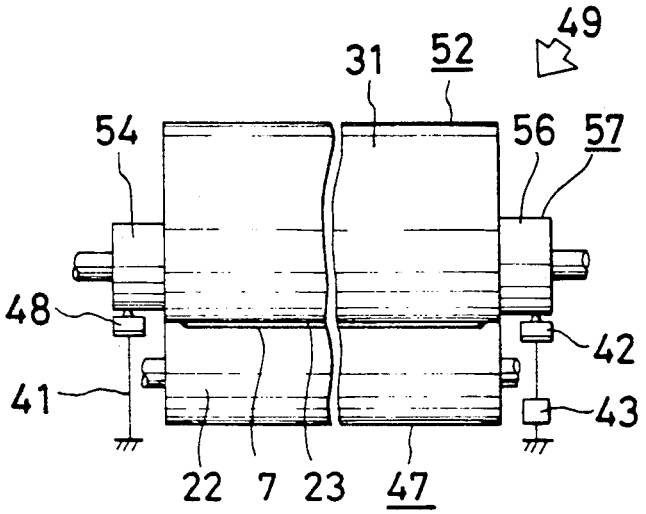
FIG. 8 is a fragmentary front view showing the whole of a third embodiment of the present invention.
Figure 9A:
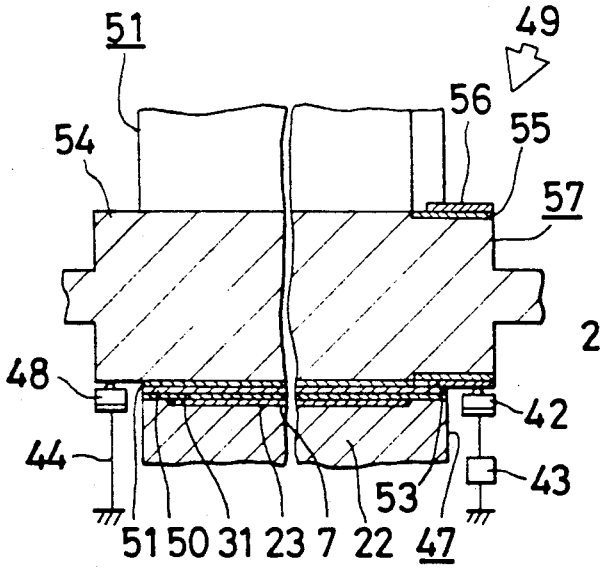
FIG. 9(*a*) is a vertical sectional front view of the device shown in FIG. 8.
Figure 9B:
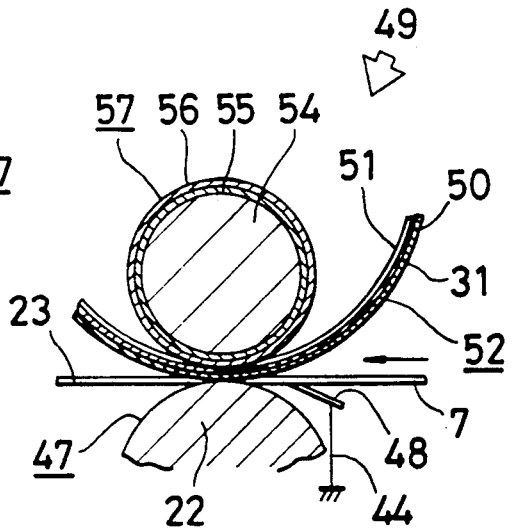

A third embodiment of the present invention will be explained based on FIG. 8 and FIG. 9. The present embodiment is an embodiment of the invention described in claims 1, 2 and 9. In the fixing device 49, for example, on the inner peripheral surface of a conductor layer 50 made of an aluminum alloy cylinder of 100 m thick, ruthenium oxide and high heat resisting epoxy resin kneaded into paste form is applied and hardened to form an exothermic resistor layer 51; on the outer peripheral surface of a conductor layer 50 a parting material layer 31 composed of fluororesin etc. is formed; thus a fixing roller 52, an exothermic member, is formed and provided. As shown in FIG. 9(*a*), on an end part of the fixing roller 52 the film of the exothermic resistor layer is not formed and the conductor layer 50 is exposed to the inner surface to form a power supplying electrode 53. On an end part of a core material 54 formed by machining or the like of aluminum alloy, an electrode ring 56, a power supplying member, is fixed through an insulating ring 55 to form an electrode roller 57, a pressing electrode member.

In the fixing device 49, the electrode roller 57 is disposed on the inner peripheral surface of the fixing roller 52 in the state where the electrode ring 56 is abutted against the power supplying electrode 53, and the fixing roller 52 and the opposing roller 47 are disposed being opposed to each other. Brushes 42 and 48, which are respectively connected to the power supply portion 43 and to the grounding line 44, are abutted against the electrode ring 56 fixed on an end of the electrode roller 57 and against another end of the electrode roller 57.

In the constitution as described above, in the fixing device 49, the current from the power supply portion 43 flows from the electrode ring 56 of the electrode roller 57 to the exothermic resistor layer 51 through the conductor layer 50, and further flows to the grounding line 44 through the core material 54 of the electrode roller 57. Thus in the fixing device 49 the exothermic resistor layer 51 is made to generates heat by the supply of power and a fixing process is performed.

Next, a fourth embodiment of the present invention will be explained based on FIG. 10. The present embodiment is an embodiment of the invention described in claims 1, 2, 4, 5 and 9. In the fixing device 58, as shown in the figure, a fixing belt 60, an exothermic member of an endless belt shape, which is stretched between two guide rollers, guiding members, is pressed against the opposing roller 27 by the electrode roller 26. The fixing belt 60 is, for example, constituted in a way as shown below: the parting material layer 31 is formed on the conductor layer 62 composed of metal etc., except its end part 63; the conductor layer 62 is formed on the peripheral surface of the exothermic resistor layer 61 composed of resin etc. The other structure is similar to that of the fixing device 24 shown in FIG. 1.

In the constitution as described in the above, the fixing device 58 functions as the fixing device 24 does. In the fixing device 58, the printing paper 23 is conveyed between the fixing belt 60 and the opposing roller 27; thereby, the holding of the printing paper is secure, which stabilizes the performance of the device. Furthermore, it can be considered to form the opposing roller 27 in the shape of an endless belt.

Figure 11A:
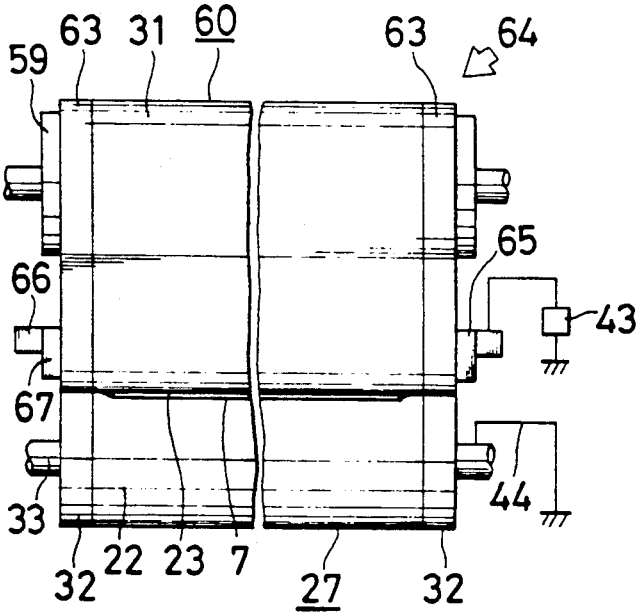
FIG. 11(*a*) is a fragmentary front view showing the whole of a fifth embodiment of the present invention.
Figure 11B:
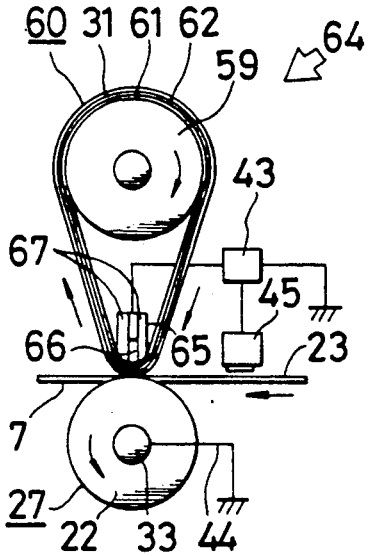

A fifth embodiment of the present invention will be explained based on FIG. 11. The present embodiment is an embodiment of the invention described in the claims 1, 4, 5 and 9. In the fixing device 64, a fixing belt 60 is stretched between one guide roller 59 and an electrode head 65, a pressing member for supplying power. The electrode head 65 comprises a metallic electrode 66 connected to the power supply portion being held between insulating boards 67 of small friction coefficient and the lower brim part of it is made to be semicircle shaped; the electrode head 65 is fixedly installed on the device and presses the fixing belt 60 freely rotatable against the opposing roller 27. The other structure is similar to that of the above-mentioned fixing device 58.

In the constitution as described in the above, the fixing device 64 functions as the fixing device 58 does. In the fixing device 64 the electrode head 65 for supplying power to the fixing belt 60 is fixedly provided, so that it can be easily connected to the power supply 43 and imperfect contact does not occur.

Figure 12:
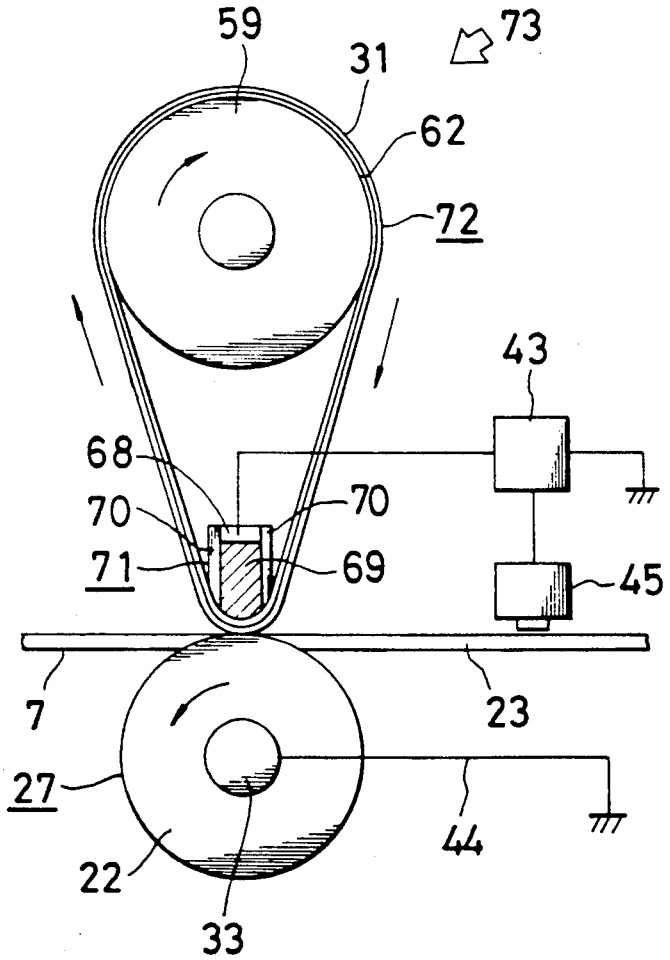
FIG. 12 is a vertical sectional side view showing a variation.

In the present embodiment, a fixing device 64 is shown in which the fixing belt 60 is supported by the electrode head 65 which is composed of a metallic electrode 66 held between insulating boards 67; but as shown in FIG. 12, it is also possible to realize a fixing device 73 in which an exothermic head 71 is provided, which comprises an exothermic resistor 69 having an electrode 68 fixed on the tip of it, being held between the insulating boards 70 composed of ceramics or alumina, and also the fixing belt 72 is provided which comprises a conductor layer 62 and a parting material layer 31 being supported by the exothermic head 71 from inner peripheral surface. In this case, it is not needed to provide an exothermic resistor layer in the fixing belt 72, and even when the exothermic head 71 is worn, the device can be recovered by changing only an exothermic resistor 69. In the fixing device 73, the exothermic resistor 69 is held between insulating boards of high specific heat, so that the heat efficiency of the exothermic head 71 is very high.

Figure 13A:
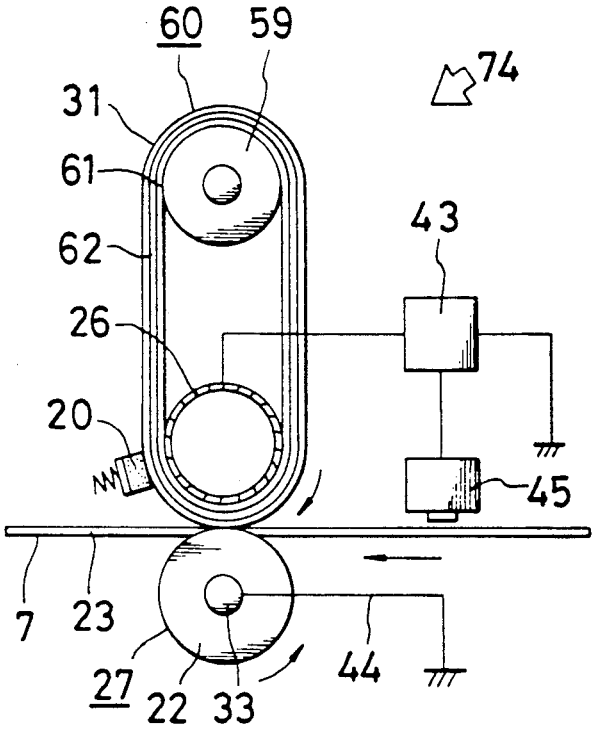
FIG. 13(*a*) is a vertical sectional side view showing the whole of a sixth embodiment of the present invention.
Figure 13B:
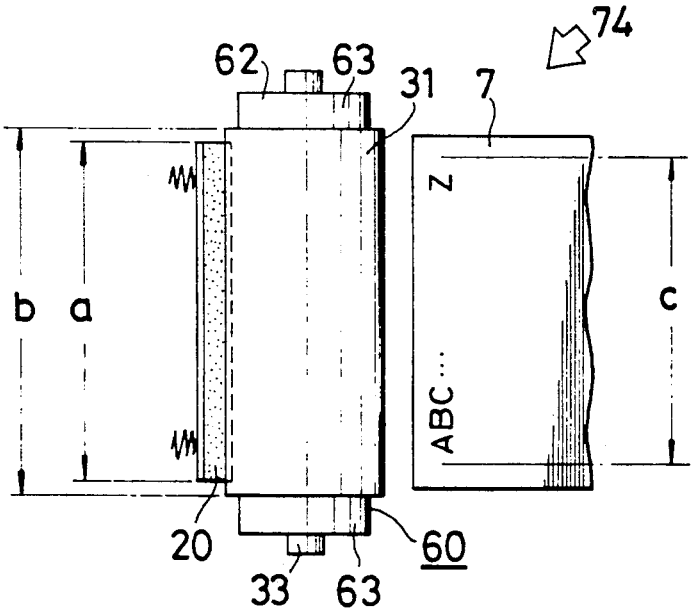

A sixth embodiment of the present invention will be explained based on FIG. 13. The present embodiment is an embodiment of the invention described in claims 1, 2, 4, 9, 11, 12 and 13. In the fixing device 74, as shown in FIG. 13(*a*), a cleaning pad 20, a cleaning means, soaked with silicon oil (not shown in the drawing), a parting liquid, is held being pressed against a bent part of the fixing belt 60 by the electrode roller 26, the fixing belt 60 which is stretched by the guide roller 59 and the electrode roller 26, each of them being a guide member. The width "a" of the cleaning pad is, as shown in FIG. 13(*b*), narrower than the width "b" of the parting material layer 31 of the fixing belt 60, and wider than the effective recording region "c" of the printing paper 7.

In the constitution as described above, the fixing device 74 functions as the above-mentioned fixing device 24 does. In the fixing device 74, as the cleaning pad 20 is pressed against a bent part of the fixing belt 60 being stretched by the electrode roller 26, the abutting condition is very good; moreover the cleaning is performed in the range where the temperature of the outer peripheral surface of the fixing belt 60 is higher than the melting temperature of toner, so that toner is easily wiped off and the outer peripheral surface of the fixing belt 60 is cleaned.

In other words, different from a conventional fixing device 1 and others, in the fixing device according to the present invention only part of the exothermic member generates heat; therefore it is supposed that because of the temperature drop of the exothermic member, the toner stuck on the belt is hardened and the cleaning becomes difficult, but in the case of the fixing device 74, as described above, toner is cleaned while it is still in a melting state, so that the outer peripheral surface of the fixing belt 60 is maintained clean; thereby the surface of the following printing paper 7 is prevented from being stained.

Furthermore in the fixing device 74, the width "a" of the cleaning pad 20 is narrower than the width "b" of the parting material layer 31, and so the silicon oil oozing out from the cleaning pad 20 is not applied to the end part 63 of the conductor layer 62 being exposed to the outer peripheral side of the fixing belt 60, which prevents the occurrence of incomplete continuity between the power supplying electrode 32 of the opposing roller 27 and the end part 63 caused by the adhesion of silicon oil on the end part 63 of the conductor layer 62.

Figure 10A:
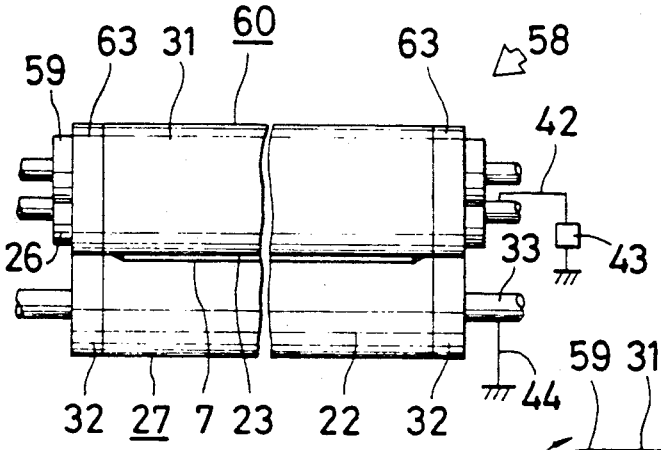
FIG. 10(*a*) is a fragmentary front view showing the whole of a fourth embodiment of the present invention.
Figure 10B:
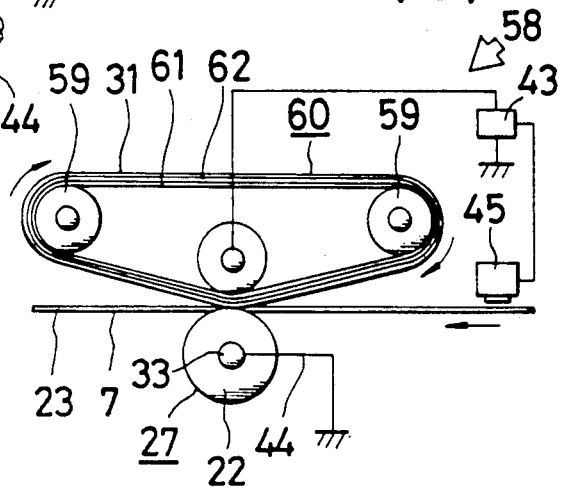

In the present embodiment, the fixing device 74 in which the cleaning pad 20 is disposed in the position opposing to the electrode roller 26 is shown; the present invention, however, is not limited to the above-mentioned constitution; for example, if the thermal insulation of the fixing belt 60 is good and the melting temperature of the toner is low, the cleaning pad can be disposed in the opposing position to the guide roller 59 of the fixing device 58 as shown in FIG. 10.

Figure 14:
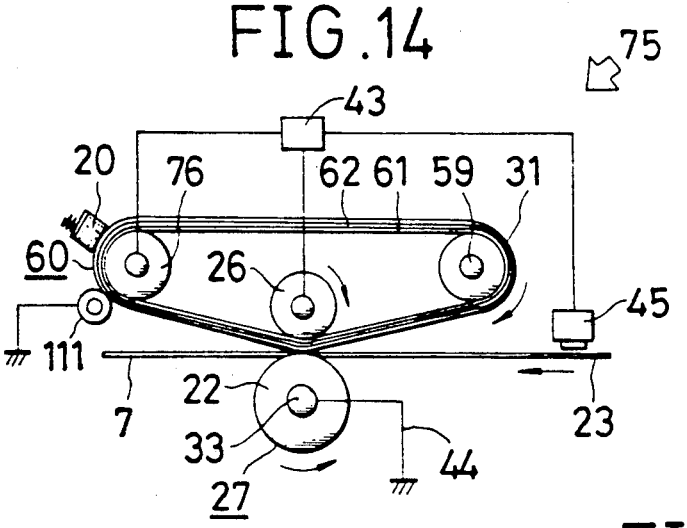
FIG. 14 is a vertical sectional side view showing the whole of the seventh embodiment of the present invention.

Next, a seventh embodiment of the present invention will be explained based on FIG. 14. The present embodiment is an embodiment of the invention described in claims 1, 2, 4, 5, 9, 10, 11, 12, 13 and 14. In the fixing device 75, the cleaning pad 20 is disposed in a position opposing to a guide roller 76, a guide member, through the fixing belt 60, and the guide roller 76 is formed to have a similar constitution to that of the electrode roller 26, and is connected to the power supply 43. For the guide roller 76, a recording electrode 111 for guidance is provided being positioned on the upper stream side than a sending position of a recording medium for the cleaning pad 20. The recording electrode 111 for guidance is connected to the conductor layer of the fixing belt 60 and the frame 35. The other structure is similar to that of the fixing device 58 or 74 etc.

In the constitution as described above, a part of the fixing device 75 against which the cleaning pad 20 of the fixing belt 60 is abutted is made to generate heat by the supply of power through the guide roller 76, so that even if the residual toner on the fixing belt 60 is stuck being hardened before the belt reaches this part the toner is again melted and it is easily wiped off.

As a power supplying electrode for supplying power through the fixing belt 60 from the guide roller 76, the power supplying electrode 32 of the opposing roller 27 can be utilized, besides that it is also possible to provide a power supplying electrode (not shown in the drawing) of exclusive use such as brushes provided on both sides of the cleaning pad.

Figure 15:
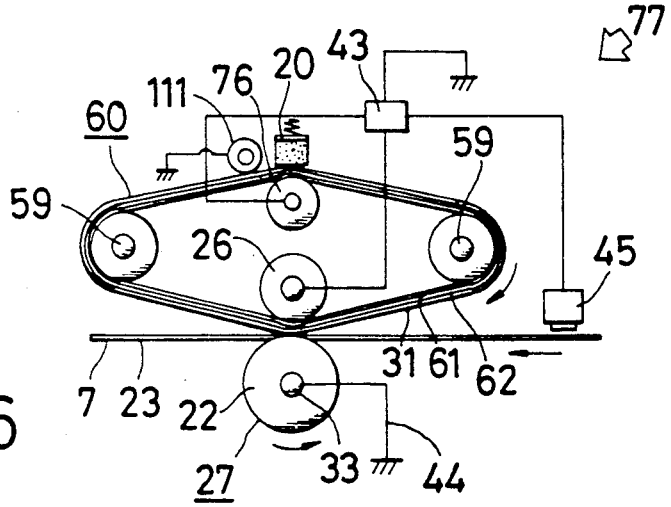
FIG. 15 is a vertical sectional side view showing a variation.
Figure 16:
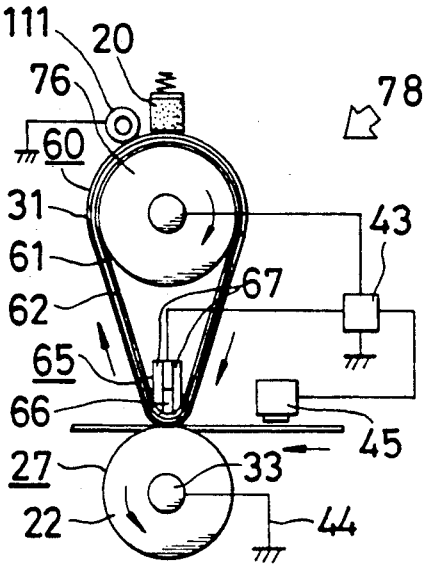
FIG. 16 is a vertical sectional side view showing another variation.

In the present embodiment, the fixing device 75 is shown in which the fixing belt 60 is stretched by the three rollers 26, 59 and 76; but the point is that a guide roller 76 for supplying power to the fixing belt 60 is provided and it is made to press and hold the cleaning pad 20; therefore the technology shown in the fixing device 75 can be applied, as shown in FIG. 15 and FIG. 16, to a fixing device 77 in which the fixing belt 60 is stretched by four rollers 26, $59_1$, $59_2$ and 76 or to a fixing device 78 in which the fixing belt 60 is stretched by one guide roller 76 and one electrode head 65.

Figure 17:
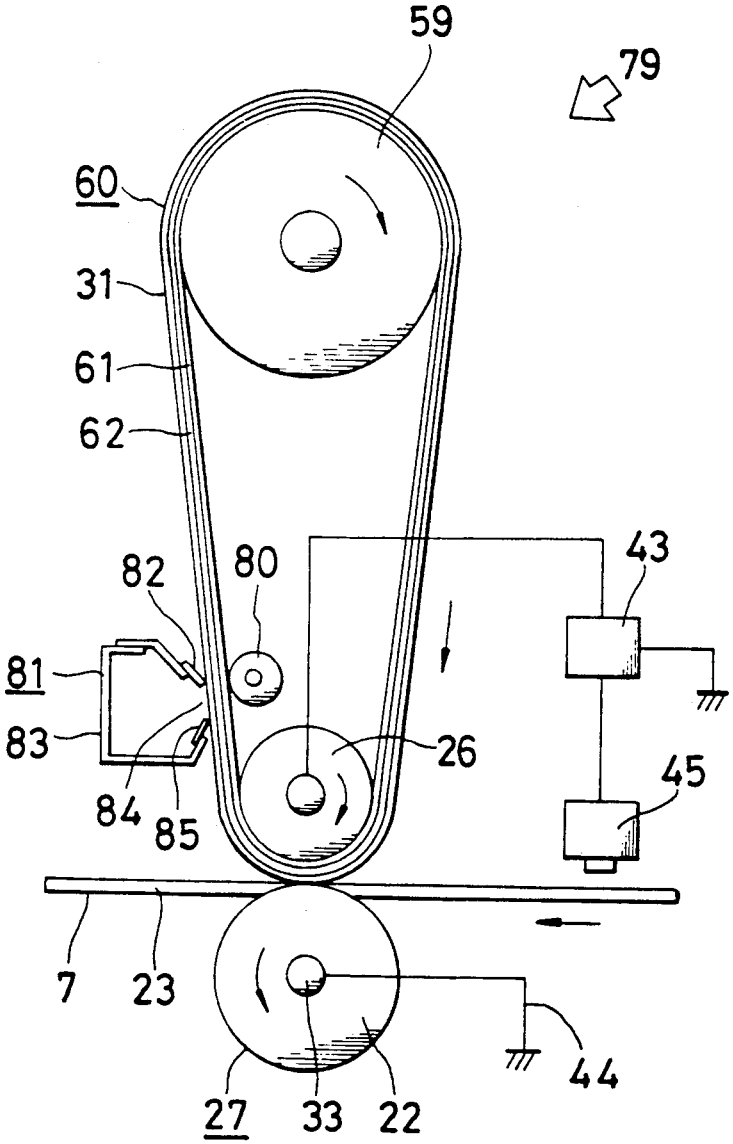
FIG. 17 is a vertical sectional side view showing the whole of a eighth embodiment of the present invention.

Further, the eighth embodiment of the present invention will be explained based on FIG. 17 to FIG. 21. The present embodiment is the embodiment of the invention described in claims 1, 2, 4, 5, 9, 15, 16, 17 and 18. In the fixing device 79 as shown in FIG. 17, a pressing roller 80, a pressing member, and a toner cleaner 81, a cleaning means, are so disposed that a part of the outer peripheral surface of the fixing belt 60 where the temperature becomes lower than the melting temperature of toner is pressed and held from inner and outer sides. The toner cleaner 81 has a structure in which a cleaning blade 82 for scraping the outer peripheral surface of the fixing belt 60 is fixed on a housing 83, a housing vessel, and a toner collector plate 85, a collector, is fixed on the lower brim part of the opening port 84 of the housing 83 protruding forward further than the front edge of the cleaning blade. The other structure is similar to that of the fixing device 74.

In the constitution as described above, the fixing device 79 is so arranged that the residual toner stuck on the outer peripheral surface of the fixing belt 60 is scraped off with the cleaning blade 82 of the toner cleaner 81 after the toner is cooled and hardened, and the collected toner is housed in the housing 83. Therefore, different from the seventh embodiment, there is no need to apply parting liquid to the surface of the fixing belt 60, which facilitates the maintenance work.

In the fixing device 79, as shown in the figure, the abutting parts between the members 82, 60 and 80 are located on a straight line connecting the front edge part of the cleaning blade 82 and the center of rotation of the pressing roller 80, so that the outer peripheral surface of the fixing belt 60 is pressed against the cleaning blade 82 properly.

In the toner cleaner 81, the cleaning blade 82 is disposed in the direction to resist the movement of the outer peripheral surface of the fixing belt 60, so that the toner is removed well.

The toner scraped off with the cleaning blade 82 is securely received into the housing 83 by the toner collector plate 85 which is protruded further than the cleaning blade 82. Thereby, dirtiness inside the device caused by toner is prevented.

The quantity of toner which is capable of being collected with the toner cleaner 81 is limited by the capacity of the housing 83, but a practical-sized device can be realized without making the toner cleaner 81 a thoughtlessly large sized one by making the capacity of the housing 83 to correspond to the life of the fixing device 79.

In the present embodiment, a fixing device 79 is shown in which a toner cleaner 81 which removes the toner on the fixing belt 60 by scraping after it is hardened is provided; in the seventh embodiment, the fixing device 74 is shown in which a cleaning pad 20 is provided which wipes off toner on the fixing belt 60 while the toner is in a melted state with silicon oil; these cleaning means 74 or 81 will be selected corresponding to the structure or the specification of equipment. In other words, in some cases the disposition of a cleaning means 74 or 81 for an exothermic member such as a fixing belt 60 can be limited by the structure of equipment or the layout of parts; in such a case, equipment may be installed easily by selecting either cleaning means 74 or 81.

Figure 18:
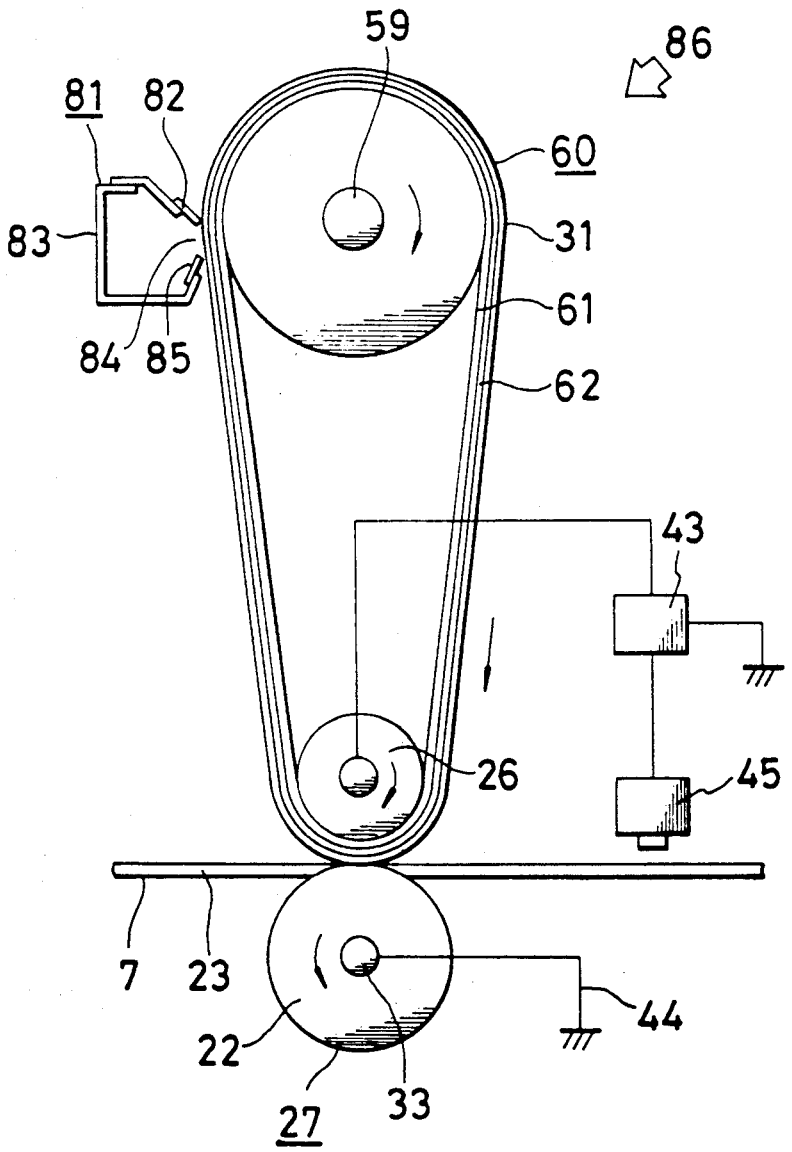
FIG. 18 is a vertical sectional side view showing a variation.
Figure 19:
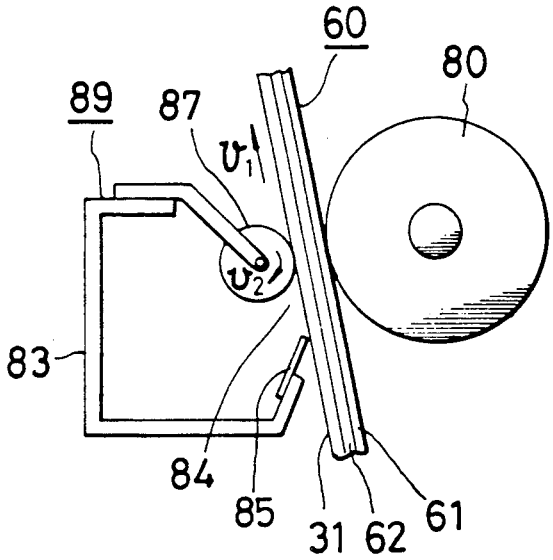
FIG. 19 is a vertical sectional side view of a toner cleaner showing another variation.
Figure 20:
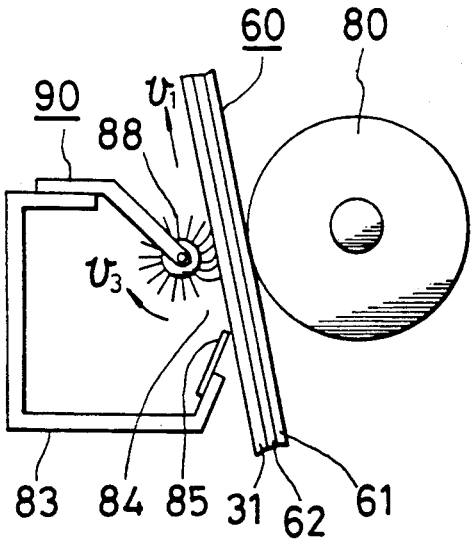
FIG. 20 is a vertical sectional side view of a toner cleaner showing a further variation.
Figure 21:
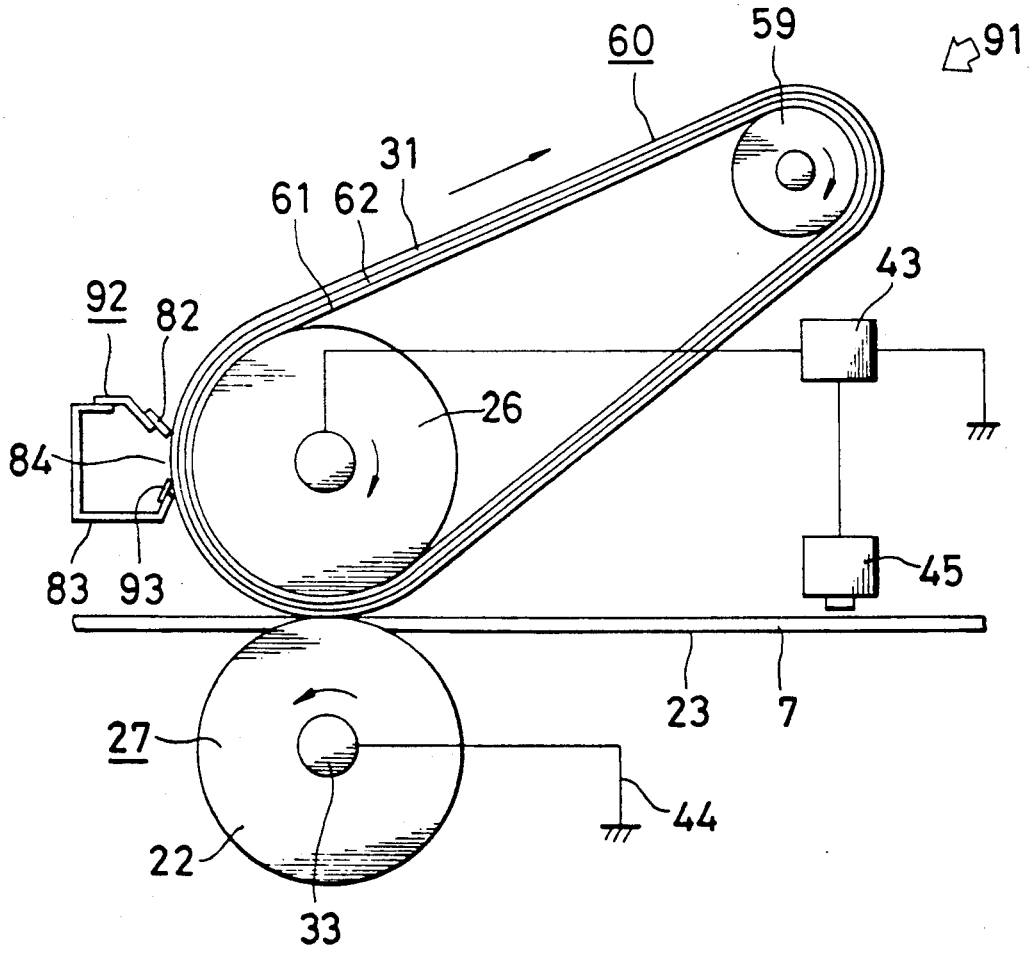
FIG. 21 is a vertical sectional side view of the whole showing yet another variation.

In the present embodiment, the fixing device 79 is shown in which the pressing roller 80, a pressing member, of exclusive use is provided being disposed opposing to the toner cleaner 81 with the fixing belt 60 between, but the present invention is not limited to above-mentioned structure; a fixing device 86 as shown in FIG. 18 can be also realized, in which the structure is simplified by commonly using a pressing member as a guide roller 59, by which the fixing belt 60 is stretched freely rotatably. In the fixing device 79 of the present embodiment, the toner cleaner 81 provided with the cleaning blade 82 is shown as a cleaning means, but the present invention is not limited to the above-mentioned structure; as shown in FIG. 19 and FIG. 20, toner cleaners 89 and 90 can also be realized which are provided with a urethane roller 87 or a nylon brush 88 which rotates in a reverse direction to the outer peripheral surface of the fixing belt 60 being connected to a driving motor (not shown in the drawing). In this case, the urethane roller 87 or a nylon brush of the toner cleaner 89 or 90 actively removes residual toner from the outer peripheral surface of the fixing belt 60; therefore, the improvement in cleaning performance can be expected. As shown in FIG. 21, a fixing device 91 of low height can also be realized in which height is lowered by disposing the guide roller 59 in a position obliquely above the electrode roller 26. In the case of the fixing device 91 described in the above, it is difficult to make the toner collector plate 93 be protruded further than the front edge of the cleaning blade 82 of the toner cleaner 92, so that the toner collector plate 93 is formed to be freely bendable to be abutted against the surface of the fixing belt 60 for collecting the toner securely.

Figure 22A:
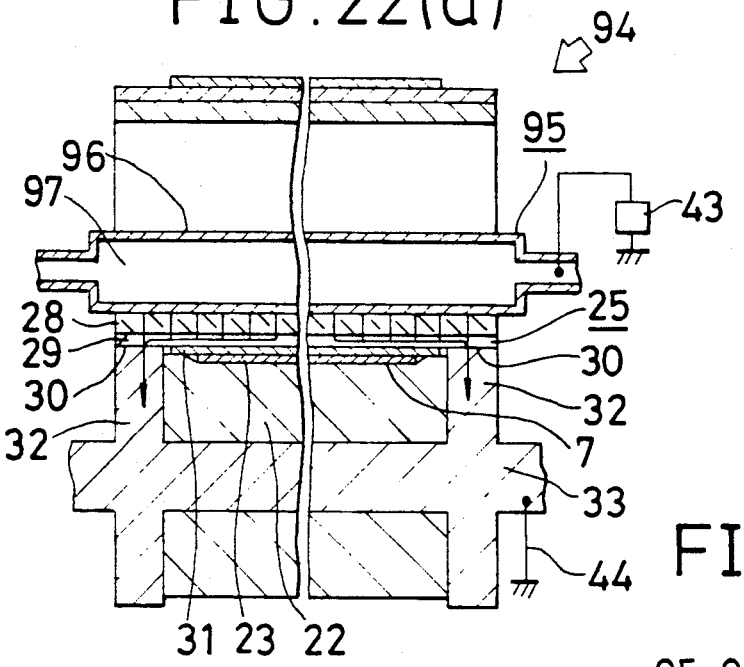
FIG. 22(*a*) is a fragmentary vertical sectional front view of the whole showing a ninth embodiment of the present invention.
Figure 22B:
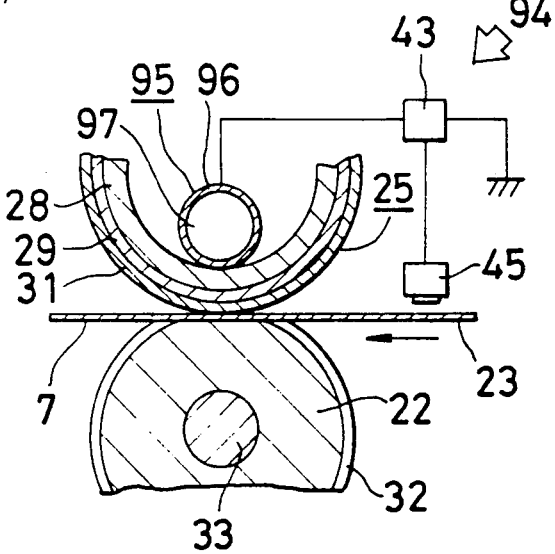

Further, a ninth embodiment will be explained based on FIG. 22. The present embodiment is the embodiment of the invention described in claims 1, 2, 4, 5, 7, 8 and 9. In the fixing device 94, an electrode roller 95, a pressing electrode member, is formed with a hollow roller-shaped metal comprising a cylindrical conductor portion 96 of low specific heat and a nonconductor portion 97, an internal space, of high specific heat. The other structure is similar to that of the above-mentioned fixing device 24.

In the constitution as described above, the fixing device 94 functions as the fixing device 24 does. The electrode roller 95 is formed with metal for keeping electric conductivity, and naturally the heat conductivity becomes high, but in the fixing device 94, the electrode roller 95 has a hollow structure in which the conductor portion 96 of good electric conductivity and the nonconductor portion 97, composed of air having good heat insulating property, are disposed adjacent to each other; thereby the heat capacity as a whole is kept low without lowering electric conductivity. In the fixing device 94, the heat quantity which flows into the frame (not shown in the drawing) from the fixing roller 25 through the electrode roller 95 is decreased, which improves heat efficiency; thereby it is made possible to decrease power consumption and also the responsibility for heat generation driving is improved.

Figure 23:
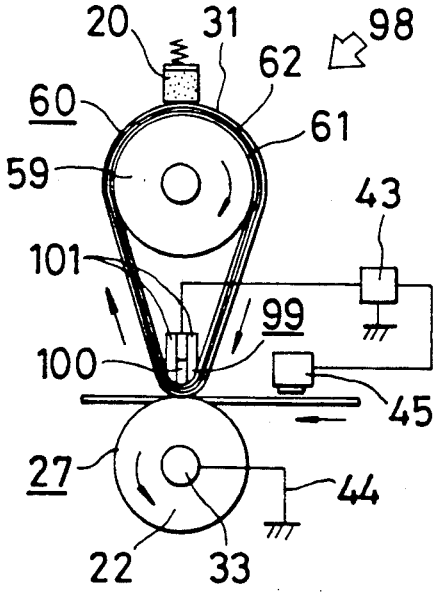
FIG. 23 is vertical sectional side view of the whole showing a tenth embodiment of the present invention.
Figure 24:
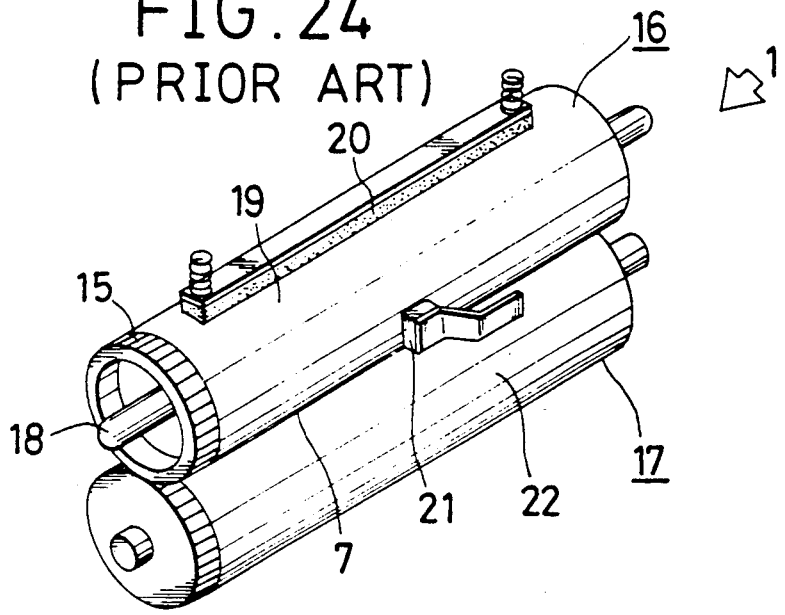
FIG. 24 (PRIOR ART)
FIG. 24 is a perspective view of the whole showing an example of a conventional device.
Figure 25A:
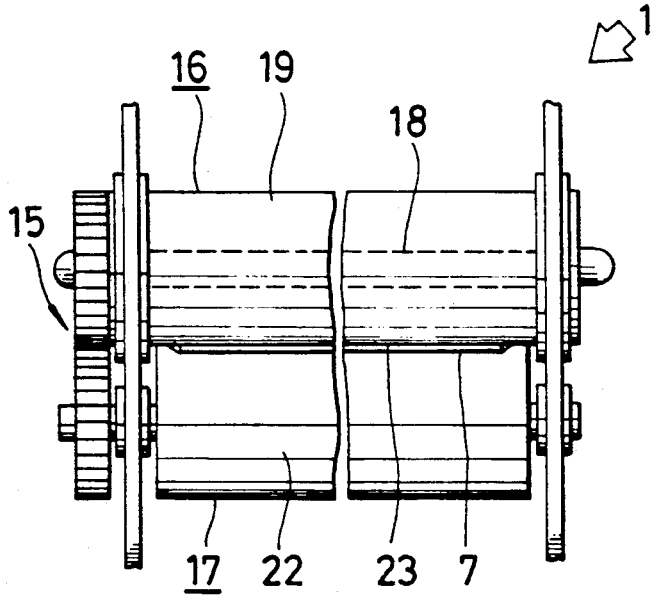
FIG. 25(a) (PRIOR ART)
FIG. 25(*a*) is a fragmentary front view of the device shown in FIG. 24.
Figure 25B:
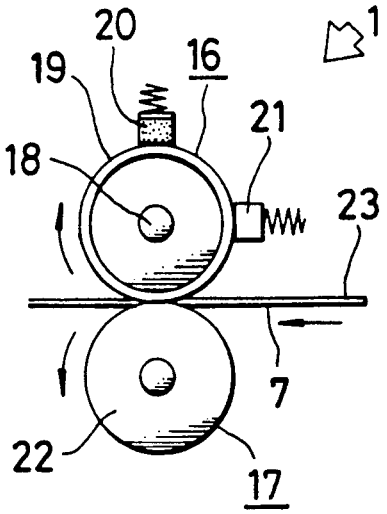
FIG. 25(b) (PRIOR ART)
Figure 26:
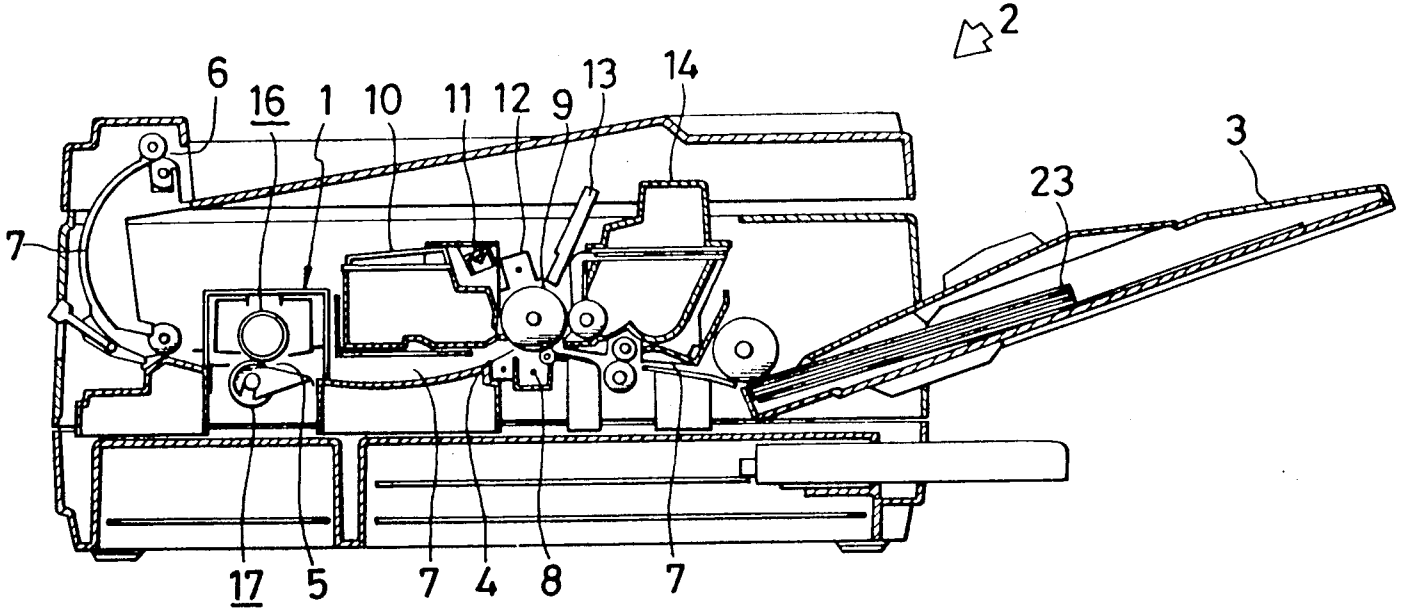
FIG. 26 is a vertical sectional side view showing an example of a laser printer.

Further, a tenth embodiment of the present invention will be explained based on FIG. 23. The present embodiment is the embodiment of the invention described in claims 1, 2, 4, 5, 7 and 9. In the fixing device 98, an electrode head 99, a pressing electrode member, has the structure in which a metallic electrode 00, an electricity conductor portion, is held between insulation plates 101, nonconductor portion, of high specific heat formed with ceramics etc. The other structure is similar to that of the above-mentioned fixing device 78.

In the constitution as described above, the fixing device 98 performs similar functions to those which the fixing device 78 does. In the fixing device 98, the heat quantity which flows into the frame (not shown in the drawing) from the fixing roller 25 through the metallic electrode 100 of the electrode head 99 is kept low by holding the metallic electrode 100 of the electrode head 99, having naturally high heat conductivity, between insulation plates 101 of good heat insulation property. Thereby, the decrease in power consumption and the improvement in responsibility can be achieved.

In the fixing device according to the present invention, various kinds of manufacturing methods for exothermic resistor layers 28, 51 and 61 of the fixing rollers 25, 52 or of a fixing belt 60 can be considered, but for example, as in the invention described in claim 6, the resistivity of an exothermic resistor can be freely set by forming the exothermic resistor layer (not shown in the drawings) with a heat resisting resin (not shown in the drawings) mixed with numerous minute pieces composed of a conductor. As conductors for forming the minute pieces, besides many kinds of metallic materials, conductive carbon black or carbon fiber can be utilized; as heat resisting resin, besides polyether-etherketone, polyethersulfon, polyetherimide, polysulfon, polyphenylenesulfide or alaimide resin, polymer alloys etc. including above-mentioned resin materials can be utilized. Various kinds of manufacturing methods for conductor layers 29, 50, 61 of the fixing rollers 25, 52 or the fixing belt 60, but for example, utilizing the materials in the market such as pipes or belts of copper, aluminum, nickel, chromium, titanium, nickel chromium, gold or stainless steel etc., the productivity of the devices can be improved. It is also possible to improve the conductivity, strength or adhesion for the exothermic resistor layers 28, 51 and 61 of the conductor layers by forming them laminating a plurality of metallic materials by sputtering. For the parting material layer 31, the films composed of parting materials can be utilized besides the coating of fluororesin.

We claim:

1. A fixing device comprising:

a freely rotatable exothermic member formed in a ring shape composed of an exothermic resistor layer of high resistivity, for generating heat when having a current supplied thereto, formed on an inner peripheral surface and a conductor layer of low resistivity formed on the outer peripheral surface of the exothermic resistor layer;

a medium-leading member forming a conveyance path for a recording medium between the outer peripheral surface of the exothermic member and making contact with the outer peripheral surface;

a pressing electrode member having a conductive connection to said exothermic resistor layer supplying current to and allowing the current to flow through said exothermic resistor layer by supporting said exothermic member in abutment against the inner peripheral surface of said exothermic member, and being positioned opposing the medium-leading member;

a power supplying electrode being connected to said conductor layer by making contact at least with an edge part on one side of said exothermic member; and a power supply for applying a voltage between the power supplying electrode and said pressing electrode member.

2. A fixing device described in claim 1 wherein the exothermic member and the pressing electrode member are formed in roller shapes and are held freely rotatably.

3. A fixing device described in claim 2 further comprising an electrode mounting/dismounting mechanism for holding a pressing electrode member to be freely mounted/dismounted.

4. A fixing device described in claim 1 wherein an exothermic member having its conductor layer exposed to the outer peripheral side of at least a brim part on one side is formed, and a power supplying electrode which is connected to the conductor layer by contact is formed on the brim part of the medium-leading member.

5. A fixing device described in claim 1 wherein power is supplied symmetrically about the width direction of the exothermic member.

6. A fixing device described in claim 1 wherein the exothermic resistor layer is formed with a heat resisting resin mixed with numerous minute pieces of conductor.

7. A fixing device described in claim 1 wherein the pressing electrode member is composed of a conductor portion which is connected to the exothermic resistor layer of the exothermic member and a nonconductor portion being located adjacent to the conductor portion and having higher specific heat than that of the conductor portion.

8. A fixing device described in claim 7 wherein the pressing electrode member, being held freely rotatably, is formed with a hollow roller-shaped member composed of a metallic cylindrical conductor portion and a nonconductor portion, an internal space of said conductor portion.

9. A fixing device comprising:

a freely rotatable exothermic member formed in a ring shape composed of an exothermic resistor layer of high resistivity, for generating heat when having a current supplied thereto, formed on the inner peripheral surface and a conductor layer of low resistivity formed on the outer peripheral surface of the exothermic resistor layer;

a medium-leading member making contact with the outer peripheral surface of the exothermic member, and forming a conveyance path between the outer peripheral surface of the exothermic member;

a pressing electrode member being located in a position opposing the medium-leading member and being connected to said exothermic resistor layer supplying current to and allowing the current to flow through said exothermic resistor layer by supporting said exothermic member in abutment against the inner peripheral surface of it;

a power supplying electrode connected to said conductor layer by making contact with at least a brim part on one side of said exothermic member;

a power supply for applying a voltage between the power supplying electrode and said pressing electrode member;

a detection sensor for detecting a recording medium moving on the conveyance path to the fixing portion; and a timer circuit for controlling the power supplying period of said power supply corresponding to the detection of the medium by the detection sensor.

10. A fixing device comprising:

a freely rotatable exothermic member formed in a ring shape composed of an exothermic resistor layer of high resistivity formed on the inner peripheral surface and a conductor layer formed on the outer peripheral surface of the exothermic resistor layer;

a medium-leading member making contact with the outer peripheral surface of the exothermic member and forming a conveyance path for recording media between the outer peripheral surface of the exothermic member;

a pressing electrode member being connected to said exothermic resistor layer by supporting said exothermic member in abutting against its inner peripheral surface, and being located in a position opposing the medium-leading member;

a power supplying electrode connected to said conductor layer by making contact with at least a brim part on one side of said exothermic member;

a power supply for applying a voltage between the power supplying electrode and said pressing electrode member;

a parting material layer, being repellent to a developing agent, formed on the outer peripheral surface of said exothermic member; and a cleaning means for wiping off residual developing agent by applying parting liquid to the parting material layer being disposed in a position to be able to have a higher temperature than a melting temperature of the residual developing agent on said parting material layer.

11. A fixing device described in claim 10 wherein the application width of the parting material in the cleaning means is made wider than the effective recording region of the recording medium, and narrower than that of the parting material layer.

12. A fixing device described in the claim 10 wherein the exothermic member is formed in a endless belt shape, and the exothermic member is held in a stretched state from inside with the pressing electrode member and at least one guide member, and the cleaning means is disposed on the outer peripheral surface of a bent part of said exothermic member bent by the guide member or said pressing electrode member.

13. A fixing device described in claim 12 wherein a freely rotatable roller-shaped guide member is formed.

14. A fixing device described in claim 12 wherein the guide member is formed with a member which is electrically connected to an exothermic resistor layer of the exothermic member; a power supplying electrode for the guide which is connected to the conductor layer of said exothermic member making contact with at least a brim part on one side of the guide member is provided; a power supply is connected to these guide members and to the power supplying electrode for the guide; and a cleaning means is disposed opposing to said guide member.

15. A fixing device comprising:

a freely rotatable exothermic member formed in a ring shape composed of an exothermic resistor layer of high resistivity formed on the inner peripheral surface and a conductor layer of low resistivity formed on the outer peripheral surface of the exothermic resistor layer;

a medium-leading member making contact with the outer peripheral surface of the exothermic member and forming a conveyance path for recording media with the outer peripheral surface in between;

a pressing electrode member being connected to said exothermic resistor layer by supporting said exothermic member in abutting against its inner peripheral surface in a position opposing the medium-leading member;

a power supplying electrode being connected to said conductor layer by making contact with at least a brim part on one side of said exothermic member;

a power supply for applying a voltage between the power supplying electrode and said pressing electrode member;

a parting material layer being repellent to the developing agent formed on the outer peripheral surface of said exothermic member; and a cleaning means for removing residual developing agent by scraping the outer peripheral surface of said parting material layer being disposed in a position to make a temperature of the parting material layer be lower than that of a melting point of the residual developing agent.

16. A fixing device described in claim 15 wherein a collector is formed for collecting developing agent removed from the exothermic member by the cleaning means.

17. A fixing device described in claim 15 wherein an exothermic member of an endless belt shape in a stretched state is formed, and a pressing member is formed in a position opposing the cleaning means with the exothermic member between.

18. A fixing device described in claim 17 wherein a pressing member is formed in a roller shape and is held freely rotatably.

* * * * *